United States Patent [19]

Desaderata

[11] Patent Number: 5,014,455

[45] Date of Patent: May 14, 1991

[54] THREE-DIMENSIONAL BOOK OR DISPLAY

[76] Inventor: The Poet Desaderata, 13811 W. Capitol Dr., Ste. 128, Brookfield, Wis. 53005

[21] Appl. No.: 423,253

[22] Filed: Oct. 18, 1989

[51] Int. Cl.[5] ..... G09F 1/08

[52] U.S. Cl. ..... 40/539; 40/124.1; 446/147

[58] Field of Search ..... 40/1, 124.1, 427, 492, 40/610, 612, 617, 530, 533, 534, 535, 536, 537, 538, 539; 446/147–152

[56] References Cited

U.S. PATENT DOCUMENTS

| | | | |
|---|---|---|---|
| 949,538 | 2/1910 | Igelstroem | 40/617 |
| 4,062,139 | 12/1977 | Klosel | 40/533 |
| 4,365,432 | 12/1982 | McCauley et al. | 40/539 |
| 4,462,145 | 7/1984 | Schulze | 40/610 |
| 4,696,118 | 9/1987 | Cross | 40/124.1 |

FOREIGN PATENT DOCUMENTS

| | | | |
|---|---|---|---|
| 1502402 | 3/1978 | United Kingdom | 40/612 |

*Primary Examiner*—Kenneth J. Dorner
*Assistant Examiner*—James M. Gardner
*Attorney, Agent, or Firm*—Arnold J. Ericsen; C. Thomas Sylke

[57] ABSTRACT

A three-dimensional book or display of three-sided pyramidal configuration including an inner pyramidal support member with its defining sides or panels being joined at their respective edges and outer overlying sides or panels hinged at the joined edges of the inner support member. The hinges comprise a flexible sheet extending laterally in opposed directions from the hinge axis to be secured to at least a portion of the inner surface of the outer panel and a portion of the outer surface of the inner panel. The invention further contemplates the provision of graphic representation on an inwardly facing surface of the panels defining the inner support member to present a kaleidoscopic representation along with another inwardly facing reflective surface of an adjoining panel.

8 Claims, 2 Drawing Sheets

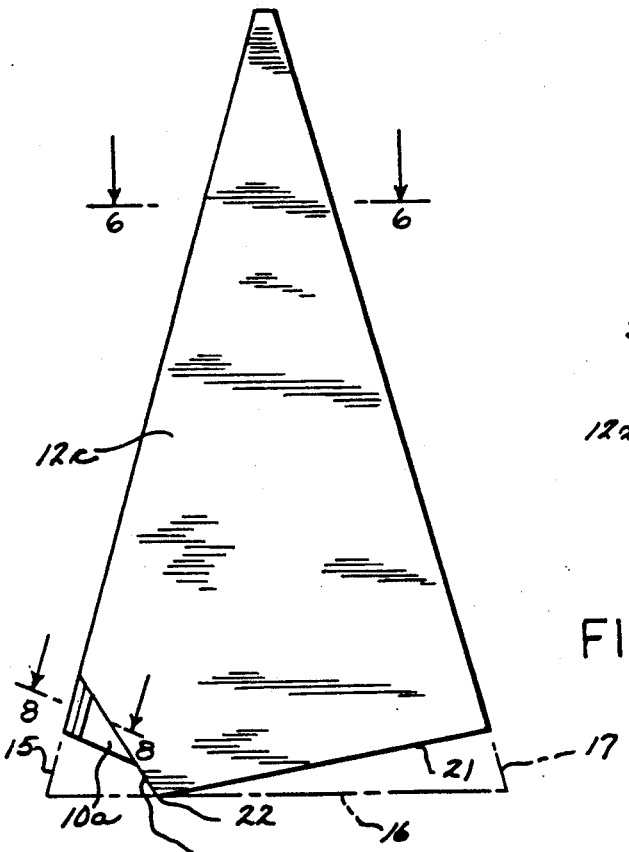
FIG. 5
FIG. 7
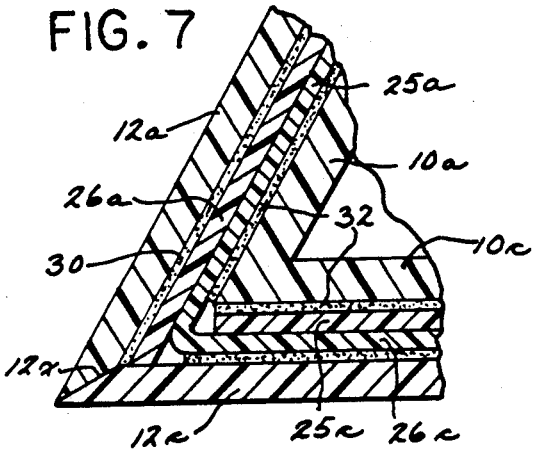
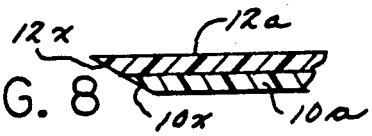
FIG. 8
FIG. 9
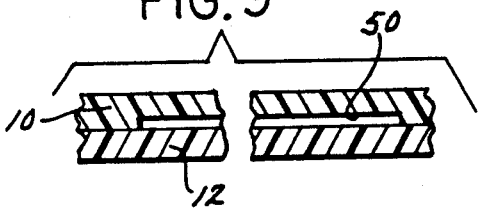
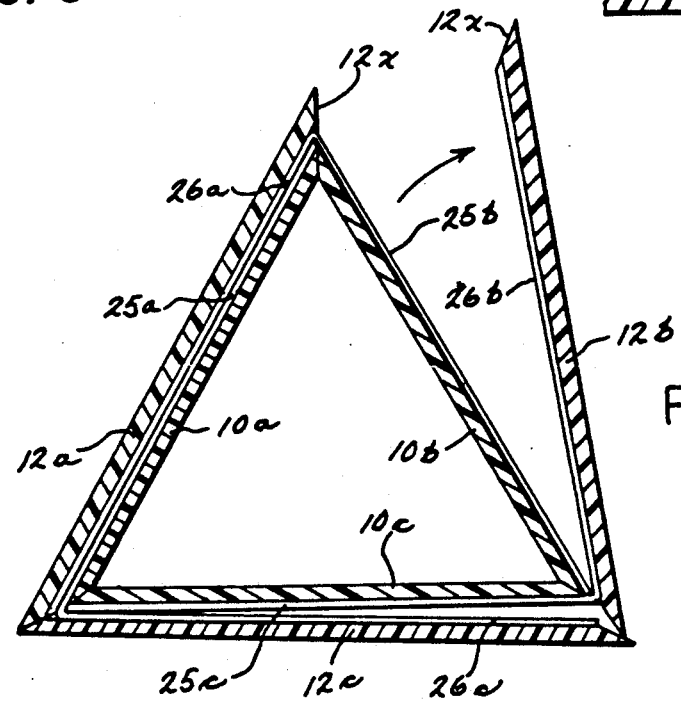
FIG. 6

THREE-DIMENSIONAL BOOK OR DISPLAY

BACKGROUND OF THE INVENTION

Field of the Invention

This invention relates to a three-dimensional book or display, and in particular, to a display of pyramidal configuration.

In the past, books containing pictorial and written graphic representations, or combinations thereof, conventionally provided a multi-page bound volume of rectilinear parallelepiped configuration. Obviously, this is a preferred configuration where a multitude of pages or leaves are required to present pictorial and written graphic representations.

In the case of displays, such as awards or trophies presented to actors and athletes, the object of display has conventionally been a stationary statuette or sculpture.

SUMMARY OF THE INVENTION

It is a principal objective of the present invention to present a novel book or display of generally pyramidal design, having an inner stationary support member defined by three polygonal panels fixedly secured to one another, and which inner support member includes a novel hinge for supporting three overlying pages or leaves, each of which may contain graphic representations on either or both sides thereof, and, if desired, on the outer surface of one or more of the fixed polygonal panels. The graphic representations may present background of an award, pictorial representation of an artist or athletes, and personal information relating to a recipient of a display statuette or trophy.

It is another object of this invention to provide a new concept for a novel greeting card which may present as many as nine available surfaces for presentation of pictorial and written graphic representations.

Still another object of the invention is to provide a multi-page book or booklet presenting a series of pages or leaves commonly hinged at mating edges of a three-sided central pyramidal support member.

It is yet another object of the present invention to provide a three-dimensional pyramidal book or display, wherein each inner and its outer panel members define a generally isosceles triangular configuration, and wherein the base of the pyramid is of equilateral triangular configuration.

It is a further object of the present invention to notch or remove a portion or portions of each of the inner and outer panel members to provide angular upwardly extending edges of the base of each panel member, said edges intersecting at a point intermediate to the ends of the base edge to provide a stable and artistic display with minimum contact with a supporting table or other flat supporting surface.

It is still another object of the present invention to provide a novel hinged connection between the respective outer and inner panels provided by a continuous sheet member having at least a portion thereof extending in opposed directions laterally inwardly of the axis of the hinge and secured to the inner surface of an outer panel member and to the outer surface of an adjacent inner panel member.

It is a still further object of the present invention to provide a three-dimensional book or display having the novel continuous hinged sheet member including at least a portion containing written or pictorial graphic representations imprinted thereon.

It is still another object of the present invention to provide the inwardly facing surfaces of two adjoining inner polygonal support panels containing graphic representations with the third inwardly facing triangular surface being reflecting.

Another object of the present invention provides a display exhibiting at least three three-dimensional pyramidal effects or illusions when viewed from an exterior perspective focal point, from a side elevation of individual panel members forming a pyramid and from the bottom of the display where a kaleidoscopic effect may be viewed.

These and other objects and advantages of the present invention will become more apparent from the detailed description thereof taken with the accompanying drawings.

In general terms, the invention comprises a three-dimensional book or display of a three-sided pyramidal configuration with a substantial equilateral base defined by an inner stationary pyramidal support member. The support member comprises three substantially identical polygonal panel members which are fixedly secured at their respective facing edges and three substantially identical polygonal outer panel members which are hinged at one edge and connected to a lateral edge of the respective inner panel member and overlying the inner panel member. The hinged connection preferably comprises a continuous sheet member with at least a portion of the sheet member extending laterally inwardly of the axis of the hinge and secured at one surface to the inner surface of an outer panel member and to the outer surface of an adjacent inner panel member. This sheet member may contain, if desired, written and or pictorial graphic representations imprinted thereon.

BRIEF DESCRIPTION OF THE DRAWINGS

FIG. 5 is a side elevational view of the embodiment of FIG. 1;

FIG. 6 is a cross-sectional view taken on line 6—6 of FIG. 5;

FIG. 7 is an enlarged fragmentary cross-sectional view taken of the lower left corner of the section illustrated in FIG. 6;

FIG. 8 is a fragmentary view illustrating the edges of adjoining inner and outer panel members to indicate the beveled configuration;

FIG. 9 is a fragmentary cross-sectional view of a second embodiment illustrating a relieved portion on at least one face of a panel member to receive an inset sheet having imprinted therein a graphic representation.

DETAILED DESCRIPTION OF THE EMBODIMENT

Figure 1:
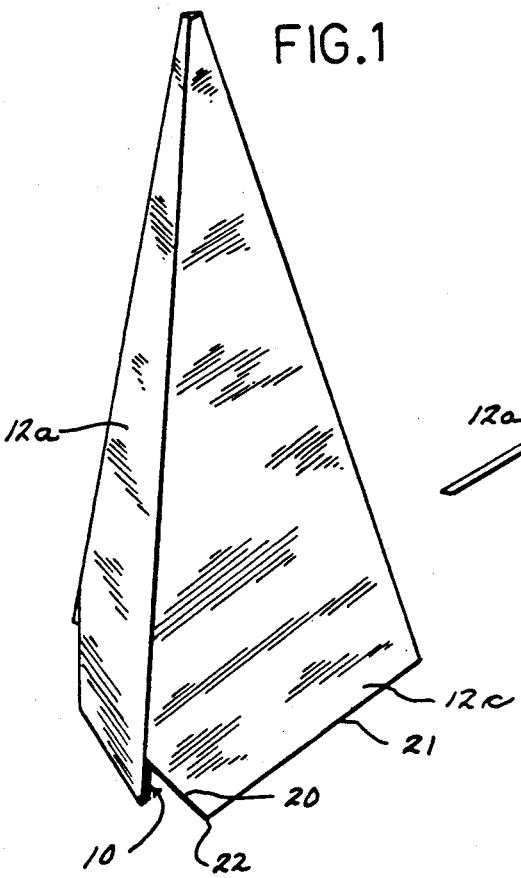
FIG. 1 is a perspective view of a preferred embodiment in accordance with the invention.

With reference to the drawings, it will be observed that the book or display of the present invention defines a generally three-sided pyramidal configuration. An inner supporting member, generally illustrated by the reference character 10, contains three fixed panels 10*a*, 10*b* and 10*c*, secured to one another at their facing edges by means of conventional sealing techniques. Hinged polygonal, outer panel members or leaves, generally referred to by the reference numeral 12, provide hinged panels or leaves 12*a*, 12*b* and 12*c* hingedly attached to the edges of the inner panel 10, as will later be described.

Another interesting effect provided by the present invention, as illustrated in the side elevational view of FIG. 5, is the use of cut-away portions. These portions are defined by phantom lines 15, 16 and 17 which define the upwardly extending edges 20 and 21 intersecting at point 22, intermediate the phantom line 16. Each of the intersections 22 of the respective panel members 10*a*, 10*b* and 10*c* and its respective overlying outer panel or leaf 12*a*, 12*b* and 12*c* are the only contact with the supporting planer surface, such as a table or top of a cabinet shelf. This provides a very stable support not unlike the well-known three-legged stool used for many years by milkmaids.

Figure 2:
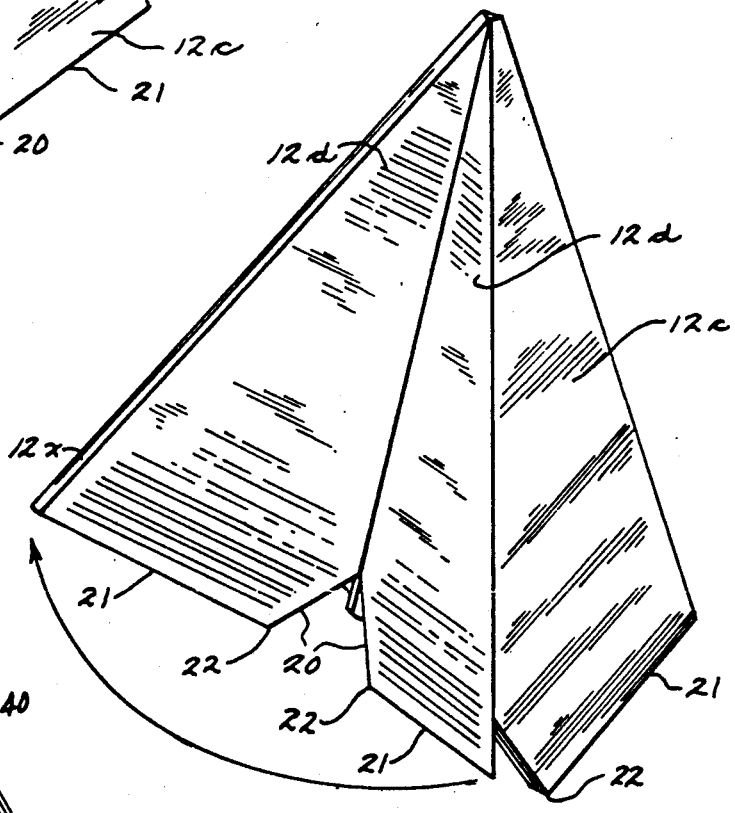
FIG. 2 is a perspective view of the book or display of the present invention illustrating one leaf or page in open position with respect to a fixed inner pyramidal support member.

The novel hinge design will next be described with reference to FIGS. 6 and 7. The preferred hinge takes advantage of the means of mounting graphic representations on an inner face of a respective panel or leaf 12*a*, 12*b* or 12*c* and the next adjacent outer face of an inner panel 10*a*, 10*b* or 10*c*. Thus, a flexible sheet, such as photographic paper, or other graphic-bearing flexible sheet may define hinge portions 25*a*, 26*c*; 25*c*; 26; and 25*b*, 26*a* extending laterally over at least a portion of the inner facing surfaces (See surface 12*d*, FIG. 2) of the outer panel 12*a*, and may be secured to the outer panel 12*a* by means of an adhesive 30.

Figure 3:
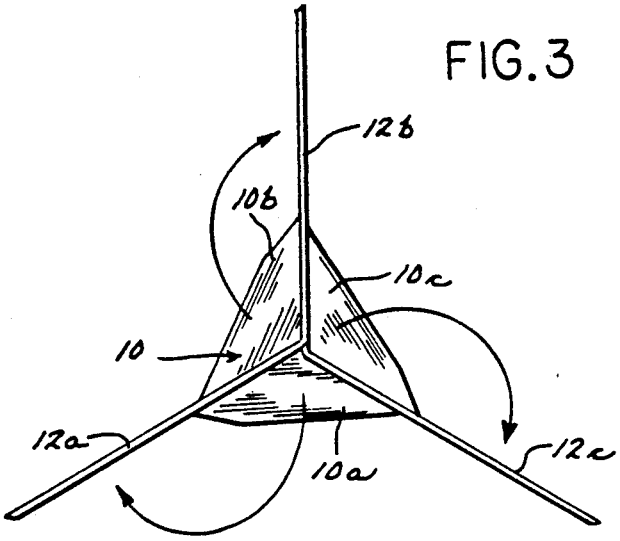
FIG. 3 is a top elevational view illustrating each of the hinged outer panels in extreme open position relative to the inner support member.

The flexible sheet 26*a* extends integrally around the apex intersection (with reference to FIG. 6) of inner panels 10*a* and 10*b* to provide the remaining hinge portion 25*b*. The hinge portion 25*b* provides an additional photo mounting surface or printing surface for other pictorial or written graphic representations. It is secured to the inner panel 10*b* by means of an adhesive 32. It will be observed from FIG. 6 that hinge portions 26*a*, 25*c*, 26*c* and 25*a* provide hinges for the outer panels 12*b* and 12*c*, respectively. Full open position of the respective outer panels 12*a*, 12*b* and 12*c* may be observed from the illustration of FIG. 3. This open arrangement will provide a further display representation.

It will be understood that the panel members 10 and 12 may be formed of a conventional, rigid plastic material, such as the well-known acrylic resin sold under the trademark "Plexiglass". Stiff paperboard or other sheet material capable of supporting a graphic display may be provided on either one or both inner or outer surfaces of the outer panels or leaves 12 or the outer surface of the inner panels 10 to provide a pyramidal three-sided book or display. In fact, it is within the province of this invention to provide panel members bearing imprints of photographs or written prose or poetry or other pictorial representations directly therein. In this embodiment, the hinge arrangement may have only a portion of a hinge member laterally extending inwardly from the hinged edges of the respective inner and outer panels. In this embodiment, it is preferred, as shown in FIG. 9, to provide a relieved inner surface 50 on either the outer surface of panel 10, as shown, or on either or both of the inner surface or outer surface of panel 12 to receive a photographic print or similar graphic print (not shown).

It will be apparent that either or both of the panels 10 or 12 may be made of transparent material to display graphic representations made on any surface of either panel. The display may be observed through the transparent surface of either or both panels, with or without lighting emanating from the inner chamber of the stationary support member formed by the inner panels 10.

Figure 4:
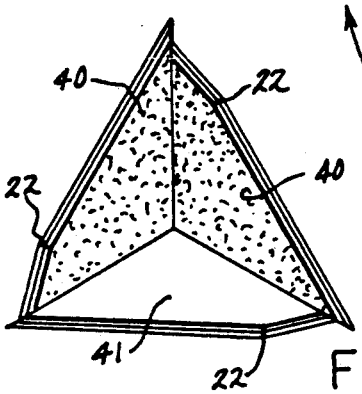
FIG. 4 is a bottom view of the book or display of the present invention with two sides of the inner facing surfaces bearing graphic representation and the third side being reflecting.

Another aspect of the novel display of the present invention may be observed from the bottom view of FIG. 4. A kaleidoscopic phenomona is presented by means of mounting or imprinting a graphic display 40 on two of the inner wall surfaces of the inner panels 10, and a reflecting surface 41 on the remaining wall. It is even more interesting when the display 40 is in the form of a holograph.

It will be apparent that a novel book or display has been illustrated and described which is capable of providing a multi-purpose presentation in the form of a general pyramidal configuration. The book or booklet may present a basic pyramidal support unit defined by three polygonal inner panels joined with one another to present both inner and outer surfaces for exhibiting graphic representations. The inner facing surfaces present a pyramidal cavity which when viewed from the bottom of the display, may be provided with graphic and reflecting surfaces presenting kaleidoscopic illusion which is even more effective when the graphics are of holographic nature.

The outer triangular surfaces of the fixed inner panels may present additional surfaces for graphic presentation, and when combined with either one or both surfaces of hinged overlying outer panels or leaves, provide additional pyramidal effects when the outer panels are either opened or closed with respect to the inner supporting structure.

While only a single embodiment, with the variation of FIG. 9, has been illustrated and described, it is not intended to be limited thereby, but only by the scope of the appended claims.

I claim:

1. A three-dimensional book or display comprising an inner stationary pyramidal support member, said support member comprising three substantially identical panel members fixedly secured at their respective facing edges, each panel member being polygonal, said support member having a three-sided pyramidal upper portion and a base portion defined by corner edges of said polygonal panel member, three substantially identical polygonal outer panel members each defining a base edge and each outer panel member being hingedly connected at a lateral edge to a respective fixedly secured edge of said support member and overlying a respective inner panel member.

2. The three-dimensional book or display of claim 1, wherein each inner and its overlying outer panel member define a generally isosceles triangular configuration.

3. The three-dimensional book of claim 2, wherein the base edge of each inner and outer panel member includes angularly upwardly extending edges intersecting at a point intermediate the said base edge.

4. The three-dimensional book or display of claim 2, wherein the respective fixedly secured edges of said inner panel members and of the adjoining hingedly connected edges of said overlying outer panel members are respectively beveled and in register with one another to provide a continuous planar mating surface.

5. The three-dimensional book or display of claim 1, wherein the hinged connection of the respective outer and inner panels comprises a continuous sheet member having at least a portion thereof extending laterally inwardly of the axis of the hinge and secured at one surface to the inner surface of an outer panel member and to the outer surface of an adjacent inner panel member.

6. The three-dimensional book or display of claim 5, wherein said continuous sheet member contains a graphic representation on at least one exposed surface thereof.

7. The three-dimensional book or display of claim 1, wherein the interior chamber of the inner stationary member includes a graphic representation on an inner facing surface of at least one polygonal inner panel member.

8. The three-dimensional book or display of claim 7, wherein the inner facing surfaces of two adjoining inner polygonal panels contain graphic representations and the third inwardly facing triangular surface is a reflecting surface.

* * * * *